US005315988A

United States Patent [19]

Clarke et al.

[11] Patent Number: 5,315,988

[45] Date of Patent: May 31, 1994

[54] REACTIVE, CLOSED-CIRCUIT UNDERWATER BREATHING APPARATUS

[75] Inventors: John R. Clarke, Panama, Fla.; Donald D. Joye, Exton, Pa.; Neal A. Carlson, Germantown; Peter Wechgelaer, Kensington, both of Md.

[73] Assignee: The United States of America as represented by the Secretary of the Navy, Washingtona, D.C.

[21] Appl. No.: 953,169

[22] Filed: Sep. 29, 1992

[51] Int. Cl.[5] ..... B63C 11/24

[52] U.S. Cl. ..... 128/204.23; 128/204.29; 128/205.13; 128/205.14; 128/205.16; 128/205.17; 128/205.22

[58] Field of Search ..... 128/200.24, 200.29, 128/204.28, 204.29, 205.13, 205.19, 205.15, 205.16, 205.17, 205.22, 204.23

[56] References Cited

U.S. PATENT DOCUMENTS

| | | | |
|---|---|---|---|
| 3,837,337 | 9/1974 | LaViolette | 128/209.22 |
| 3,877,425 | 4/1975 | O'Neill | 128/204.22 |
| 3,934,581 | 1/1976 | O'Neill | 128/204.22 |
| 4,440,166 | 4/1984 | Winkler et al. | 128/204.22 |
| 4,964,404 | 10/1990 | Stone | 128/204.22 |
| 5,195,516 | 3/1993 | Grimsey | 128/204.26 |

OTHER PUBLICATIONS

Younes et al, Am. Physiol. Soc.; 0161-7567/87, pp. 2491-2499.

Van Liew, Undersea Biomed. Res.; vol. 14, No. 2, Mar. 87, pp. 149-160.

Fishman, Handbook of Physiology-Am. Physiol. Soc.; 87, pp. 145-177.

Joye et al, Formulation of Elastic Loading . . . ; NMRI Nov. 1989.

*Primary Examiner*—Edgar S. Burr

*Assistant Examiner*—Eric P. Raciti

*Attorney, Agent, or Firm*—A. David Spevack; William C. Garvert

[57] ABSTRACT

This invention comprises a tunable underwater breathing apparatus (UBA) in which the resonant frequency of the UBA may be adjusted to meet the diver's breathing frequency by controlling the inertance component of the UBA impedance. The principles of the present invention may be adapted to existing UBA with minor redesign and some additions.

14 Claims, 3 Drawing Sheets

REACTIVE, CLOSED-CIRCUIT UNDERWATER BREATHING APPARATUS

Background of the Invention

1. Field of the Invention

This invention relates to the field of underwater breathing apparatus (UBA), more specifically to self-contained, closed-circuit underwater breathing apparatus, which operates without need of air or breathing gas from an outside supply remote from the diver, and wherein carbon dioxide gas ($CO_2$) generated by a diver is constantly removed and oxygen ($O_2$) needed for metabolism is constantly supplied.

2. Description of the Prior Art

A closed-circuit UBA is a form of self-contained underwater breathing apparatus (SCUBA) in which a diver's breathing gas is recycled through a closed loop, adding oxygen and removing carbon dioxide gases as needed. The carbon dioxide gas is typically removed by chemical absorption. UBA typically comprise an oxygen supply bottle, a canister containing $CO_2$ absorbent, a breathing bag or flexible volume element, connecting hoses, a mouthpiece for the diver, and a diluent gas or inert gas bottle. Inert gases such as helium or helium/nitrogen mixtures are often used. Some UBA versions monitor $O_2$ electronically and add oxygen when inspired $O_2$ concentrations drop below desired levels. The only mechanical adjustments that can be made by a diver involve the degree of filling of the breathing bags. As ambient pressure changes, for example as the diver goes deeper or rises, the volume of gas within the breathing bag(s) contracts or expands respectively, and diluent gas may be added or dumped, either manually or automatically. Some UBA have a single breathing bag; others have one for the inhalation side and another for the exhalation side of the recirculating loop.

The closed-circuit breathing apparatus and its basic construction and principles of operation have been known for some time (U.S. Pat. No. 3,837,337 to LaViolette, 1974). Improvements to such equipment are always being made for the diving community, which includes military, commercial underwater construction and salvage, and sport divers. For example, improvements in the control of air or breathing gas flow within the apparatus are discussed in U.S. Pat. No. 4,440,166 to Winkler, et al, (1984), particularly with respect to emergency mechanical control system in the event that the electronics fails.

The large majority of patents in the art center around the two critical performance factors for UBA, namely $CO_2$ absorption and $O_2$ control. Almost none deal with improving or lessening the difficulty of breathing at depth, particularly during arduous exercise or heavy work. Those that do, deal only with the fluid mechanical flow resistance and not other sources of impedance or mechanical resistance to breathing arising from the elements in the UBA including tubing or hoses, canister, etc. In general, breathing resistance in a UBA can be significant for the diver; it can reduce his effectiveness or the duration of work capability, and may, more seriously, contribute to loss of consciousness.

The mechanical resistance to breathing on a UBA is complex, because the breathing is sinusoidal or periodic in nature and not a steady flow. In this kind of flow situation dynamic analyses must be employed, such as those common to the art and discussed in detail by R. Peslin and J. J. Fredberg, "Oscillation Mechanics of the Respiratory System", chap. 11 in *Handbook of Physiology: Vol. III, The Respiratory System*, A. P. Fishman (ed.), 1987, American Physiol. Soc., Bethesda, Md., and H. D. Van Liew, "The Electrical-Respiratory Analogy When Gas Density is High", Undersea Biomedical Research, vol. 14, no. 2, (1987) pp. 149-160.

In a periodic flow, allowance must be made for additional resistances to the motion of the breathing gas. These resistances are termed elastic and inertial, and they cause increased energy loss, because the diver must overcome them, as well as the resistance due to flow, to keep breathing. Inertial resistance or inertance arises from accelerations and decelerations in the gas flow or displaced water due to the periodic nature of the flow. Elastic resistance or elastance arises from pressure changes due to flow entering a closed volume or pressure changes due to volume changes (in submersed breathing bags for example). Because of the oscillatory or periodic nature of the flow, complex algebra must be used to describe the overall resistance to flow, which is termed the impedance. Therefore;

$$Z=R-(jE/\omega)+j\omega I \qquad \text{Eqn. 1}$$

where Z is the impedance in units of pressure/flow rate, R is the resistance due purely to flow (the flow resistance) in the same units, E is the elastance in units of pressure/volume, I is the inertance in units of pressure/flow acceleration, and $\omega$ is the radian frequency in units of reciprocal time. Eqn. 1 applies to a series arrangement of R, E and I typical of UBA. Impedance is composed of a real part, namely the flow resistance, and an imaginary part, which is a combination of the inertance and the elastance. The magnitude of Z can be computed by;

$$|Z|=\sqrt{[R^2+(\omega I-E/\omega)^2]} \qquad \text{Eqn. 2}$$

so that all three components of impedance contribute to the pressure required to drive the flow in the system.

At the natural or resonant frequency, the inertial and elastic terms in Eqn. 2 cancel, leaving only the flow resistance contributing to the impedance. Thus impedance is at a minimal value when the system is oscillating at the natural frequency, the condition of which is given below;

$$\omega_n=\sqrt{(E/I)} \qquad \text{Eqn. 3}$$

The foregoing are terms of the art necessary to understand the present invention, but they do not constitute the invention.

Impedance in the UBA adds to the positive and negative respiratory pressures that a diver must generate to breathe. Impedance is generated by the elastance, inertance and resistance in the UBA. Resistance in UBA arises from breathing hoses, valves, changes in flow diameter, the canister and other similar obstructions in the flow path. Resistance is the fluid mechanical cost of moving a volume of fluid at a given rate. The ratio of pressure difference required to cause a given flow rate to the flow rate is termed the flow resistance.

Elastance is the reciprocal of compliance in the system and is derived in UBA primarily from changes in volume of the breathing bag when immersed. If these changes in volume lead to a vertical expansion or contraction of the bag, pressure is altered by hydrostatic forces, wherein the pressure change ($\Delta P$) is given by;

$$\Delta P = \rho g \Delta h \quad \text{Eqn. 4}$$

where $\Delta h$ is the vertical displacement and $\rho$ is the density of ambient fluid, usually water or sea water, and g is the acceleration of gravity. The shape of the bag and its orientation in the water have an effect of the elastance. Reference is made to D. D. Joye, J. R. Clarke, N. A. Carlson and E. T. Flynn, "Formulation of Elastic Loading Parameters for Studies of Closed-Circuit Underwater Breathing Systems", NMRI Technical Report 89-89, Bethesda, Maryland (also available from NTIS). Elastance is inversely proportional to the cross-sectional area that is perpendicular to the vertical direction. In general, as the breathing bag changes volume, the hydrostatic component of pressure from the top to the bottom of the bag is the elastic pressure. There are other contributions to elastance in a UBA, for example the volume of internal hoses and containers in the breathing loop, that have an additional, but much smaller, effect.

Inertance arises from the acceleration of mass in a system. The larger the mass the higher the inertance. Accelerated masses comprise breathing gases, water displaced by the breathing bag and various UBA components. Inertance (I) is calculated from the formula:

$$I = m/A^2 \quad \text{Eqn. 5}$$

where m is mass and A is the cross-sectional area through which mass is moved, or the sectional area which moves with the mass.

The force that moves the flow of breathing gas is respiratory pressure. Although the respiratory pressure imposed by UBA elastance can be relatively high at the low frequencies commonly encountered in a diver's breathing pattern, which is typically in the range 5-60 breaths/minute, particularly 10-40 bpm, there have been no efforts to either statically or dynamically reduce UBA elastic impedance to make it easier for the diver to breathe.

Some efforts have been made in the design of breathing machines (not UBA) that simulate human breathing or can be adjusted to generate other breathing conditions, and/or to provide adjustable impedance. Reference is made to M. Younes, D. Bilan, D. Jung and H. Kroker, "An apparatus for altering the mechanical load of the respiratory system", J. Applied Physiology, vol. 62, no. 6 (1987) pp. 2491-2499, wherein adjustment to elastance by changing gas volume in the machine is shown. Inertance is not adjusted, and oscillatory behavior is damped, not fostered.

SUMMARY OF THE INVENTION

Accordingly, an object of this invention is to reduce the impedance in a UBA by changing the inertance so that elastic and inertial contribution to impedance cancel.

A further object of this invention is to provide a means for continual adjustment of the inertance in a UBA to change the natural frequency of the UBA, so that the resonant frequency of the UBA is equal to the diver's breathing frequency, thereby minimizing impedance to breathing.

These and additional objects of the invention are accomplished by tuning a UBA, by which is meant adjusting inertance so that the natural frequency of the UBA is modified to equal the breathing frequency of a diver using the UBA. Inertance is altered in a controlled manner by adjusting mass associated with motion of the breathing bag, particularly the mass of water moved by displacement of the breathing bag The invention comprises (a) a means for sensing the physical variables of a diver's breathing, particularly the diver's breathing frequency, (b) a means for determining elastance of the UBA, (c) a means for computing the resonant frequency of the UBA, and (d) means for changing the inertance of the UBA so that the resonant frequency of the UBA always equals the diver's breathing frequency.

BRIEF DESCRIPTION OF THE DRAWINGS

A more complete appreciation of the invention will be readily obtained by reference to the following Description of the Preferred Embodiments and the accompanying drawings The representation in the figure is diagrammatic and no attempt is made to indicate actual scales or precise ratios.

FIG. 1(*a*) is a schematic showing the telescopic tube embodiment in place of the bellows-type extendable tube embodiment of FIG. 1.

FIG. 2(*a*) is a schematic showing the moving mass embodiment in place of the inertance tube embodiment of FIG. 2.

FIG. 3(*a*) is a side view of the embodiment illustrated in FIG. 3.

DESCRIPTION OF THE PREFERRED EMBODIMENTS

Figure 1:
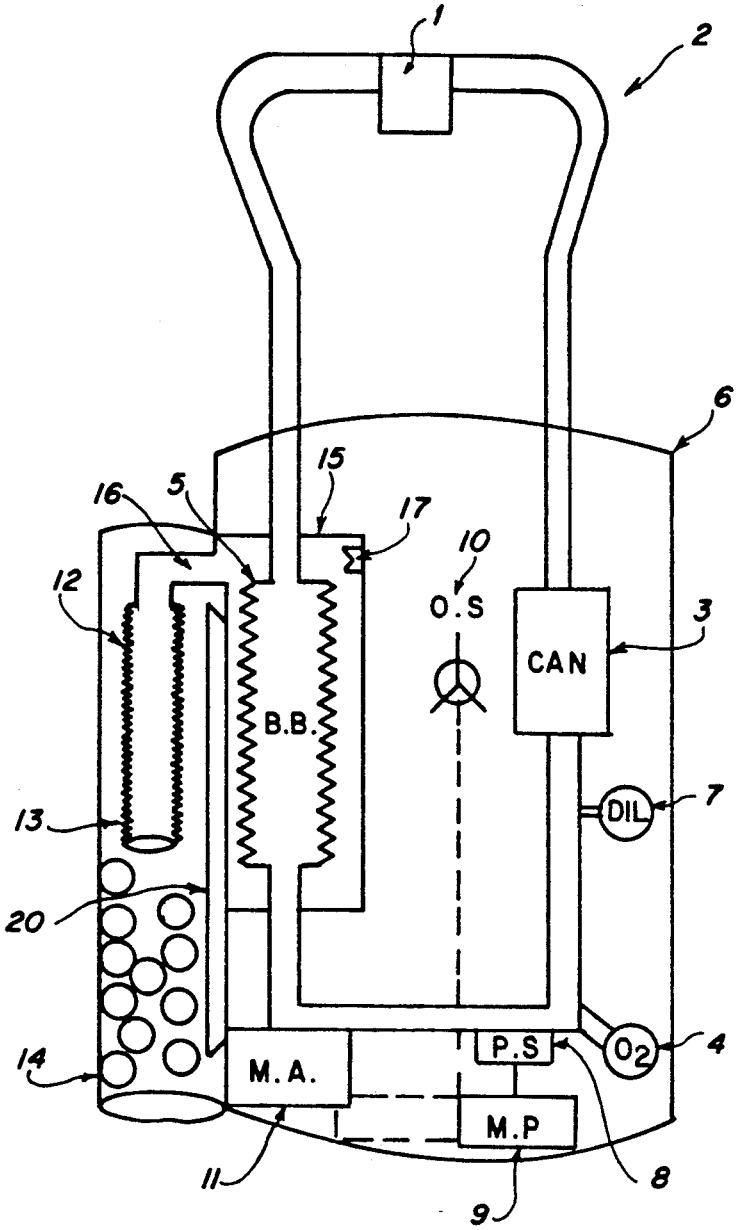
FIG. 1 is a schematic view of a preferred embodiment of the present invention (adjustable length hose) in cooperation with the other elements of the invention incorporated into an otherwise typical recirculating underwater breathing apparatus.
Figure 1A:
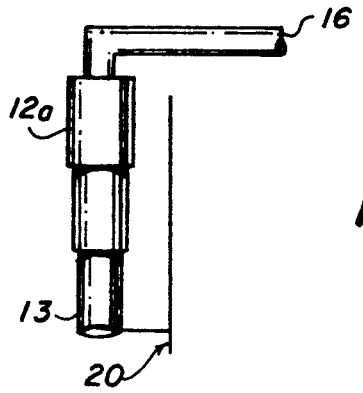

The means for sensing a diver's breathing frequency comprises a pressure transducer, built into the UBA respiratory circuit and a microprocessor, which computes respiratory frequency from the periodicity of a pressure waveform characteristic of the diver's breathing pattern. The pressure transducer may be of any type current in the diving art, such as the metal diaphragm differential pressure cells manufactured by Validyne Engineering Corporation, Northridge, Calif., or a miniaturized piezoelectric device adapted for use underwater, or pressure transducers whose working principles can be adapted for underwater use. These transducers sense differential pressure by deflection of a diaphragm or stretching of a thin film of material changing the resistance or electrical properties of the material, which can be sensed as a voltage or current change. The microprocessor can be any adaptation of similar units commonly used in automobiles today to monitor engine function and effect changes in the operating variables. The appropriate circuit design simply needs to be carried out and the unit programmed to obtain the desired functional performance. This is well within the skill of the present electronic art. Frequency can be sensed from pressure waveform by counting peaks (from the diver's mouth pressure) and measuring the time elapsed between peaks.

The means for determining elastance of the UBA comprises look-up tables, programmed tables, and the like. Here again the microprocessor can be used with a different program to compute the elastance, for example by methods described in the Joye, et al reference cited previously. Elastance, to a first approximation, is equal to the inverse of the horizontal cross-sectional area of the breathing bag or counterlung. Since no counterlung is spherical in shape, and since a diver will assume any orientation in the water, elastance depends on the shape of the bag and the orientation. A table of elastance as a function of orientation can be prepared by simple experiments on an actual UBA in the water in vertical, horizontal and rotational positions, and the computer can interpolate between these values as appropriate. These values can be provided by the manufacturer or determined by standard techniques without undue effort.

Since elastance will depend on orientation of the breathing bag in the water for most geometrical design possibilities, a 3-axis position indicator, located within the UBA will be necessary to accurately compute elastance. Position indicators are more common to the aerospace art, particularly airplanes with pitch (up and down at the head), yaw (side-to-side) and roll axes and displays common in the cockpit. A position indicator adapted for use underwater is described here as an example: Three pressure transducers are placed in a horizontal plane on the breathing bag housing, and pitch, roll and yaw are determined by the different readings on these transducers. For example, the north transducer reads pressure A, the west transducer reads pressure B, and the east transducer reads pressure C. If $A=B=C$, the diver is horizontal (pressure is relative to a common point on the UBA, preferably in the center. If $B>C$ and both greater than A, then the diver is pitched down at the head and rolling to the right. The degree to which this is true depends on the magnitude of the pressure signals. Many other combinations could be discussed, but the principle is clear.

The means for computing the resonant frequency of the UBA comprises a microprocessor which computes the adjustment in the inertance of the UBA breathing bags needed to minimize impedance, for example through Eqn (3). The means for changing inertance comprises any means selected from the following: (a) changing the mass of water displaced by motion of the breathing bag by altering the geometry of an exit hose, for example changing the length of this hose through telescoping means, attached to the breathing bag housing, an otherwise closed structure placed over the breathing bag for protection, (b) changing the moment of inertia of the breathing bags, for example adding or removing mass attached thereto, (c) changing the geometry of the breathing bag housing or hose by having holes placed in either, and having a means to open or close those holes to change the primary direction of flow of the water displaced by motion of the breathing bags, for example axial to radial, and (d) using a valve and a fixed length of hose, wherein the valve bleeds off water in the hose by adding a parallel escape path for water to be diverted away from moving through the fixed length of hose.

The reactive UBA of the present invention requires that inertance be known for the above mentioned methods as a function of geometric variable, for example the length of an adjustable-length tube. The microprocessor computes the required inertance from Eqn (3), then the corresponding length of tube that gives that inertance. The microprocessor then compares the length required to that existing and this signal is sent to a mechanical means for adjusting the length of the tube, for example. The mechanical system may comprise any kind of linkage that can change the tube length.

Old UBA were designed to minimize only resistive impedance; they did not react to the diver, other than to maintain minimal inspired partial pressure of oxygen. In addition to performing all the functions of existing UBA, the new "Reactive UBA" will continually minimize UBA impedance by tuning the UBA to resonate at the diver's respiratory frequency.

Having described the invention, the following examples are given to illustrate specific applications of the invention including the best mode now known to perform the invention. There may be other ways to do the basic tasks of the present invention, once the invention is known, thus these specific examples are not intended to limit the scope of the invention described in this application.

With reference to FIG. 1, basic elements of the UBA and features of the present invention are shown. The diver breathes on mouthpiece [1]. Breathing gas circulates through hose [2]; arrows show direction of gas flow. The $CO_2$ from the diver's exhale gas is absorbed in canister [3], make-up oxygen is added by oxygen bottle [4] as needed. The breathing bag [5] provides a capacitance in the system. The UBA housing [6] is generally porous to water, so all the elements are in a water environment. Diluent gas bottle [7] for adjusting volume in the breathing bag is also shown.

With respect to the elements of the present invention, pressure is sensed by pressure transducer [8] which sends a signal to microprocessor [9], which then determines the breathing frequency of the diver from the pressure pulse waveform. Microprocessor [9] also receives a signal from the 3-axis orientation transducer [10], computes the elastance from appropriate tables and formulae, then also computes the inertance required to match UBA resonant frequency to the diver's breathing frequency. Microprocessor [9] may need, additionally, position information from an electro-mechanical actuator [11], if the microprocessor is a separate unit from the electro-mechanical actuator, as is shown in FIG. 1. Alternatively microprocessor [9] can be built into the electro-mechanical actuator, so that the position of the actuator can be sensed directly, through gears, for example, or otherwise, rather than remotely. Microprocessor [9] compares the frequency of the diver's breathing to the computed resonant frequency of the UBA and sends an appropriate signal to the electro-mechanical actuator [11] which then adjusts the length of an extendable tube [12], for example a tube with bellows, or a more smooth-walled telescoping tube, through mechanical or magnetic means [13]. In the alternative embodiment, FIG. 1(*a*) shows telescopic tube [12*a*] in place of bellows type extendable tube [12] of FIG. 1. This is a simple alternative that operates similar to a slide trombone. All other parts remain the same. Adjusting the length of the tube [12] changes the inertance of the UBA by changing the mass of water that is accelerated by breathing bag displacement. The extendable hose [12] of FIG. 1 moves in a porous housing [14] for retention and protection. The breathing bag is contained in an otherwise sealed compartment [15], so that all water displaced by the changing volume of the breathing bag is forced out hole [16] into hose [12].

Alternatively, for access of water, initially, to compartment [15], the compartment may be fitted with a valve [17].

Mechanical means [13] may comprise an endless, flexible cable fixedly attached at one point to a moveable, outlet end of extendable hose [12]. The other end of extendable hose [12] is fixedly attached to the sealed compartment [15] containing the breathing bag at hole [16]. Alternatively, magnetic means may be used to move the hose; or a worm gear and rack, or other mechanical linkage devices adaptable from the art may be used to change the length of extendable hose [12] by moving the hose outlet.

In order to return hose or shorten its length, a spring-loaded return mechanism is preferred. Other mechanisms are within the skill of the art, as it is well known that it is easier to extend a flexible member than it is to contract or compress it.

The length of extendable hose [12] may need to be longer than the shoulder-to-hip length shown in FIG. 1. In these cases alternative designs for moving the hose in a confined space can be used. For example, a rotating, circular disc, as illustrated in FIG. 3, to which a moveable end of the hose is attached may be used.

Figure 3:
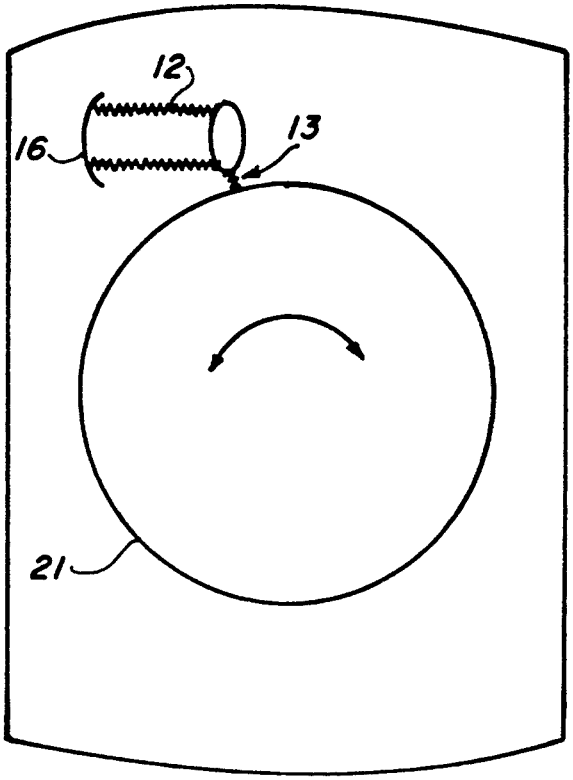
FIG. 3 is a schematic in plan view showing the rotating disc embodiment in place of the endless cable element of the mechanical actuator embodiment illustrated in FIG. 2.
Figure 3A:
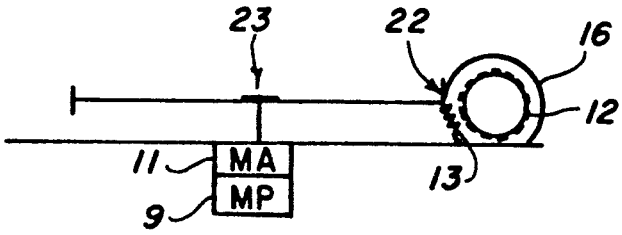

FIG. 3 shows the rotating disc [21] embodiment in which the disc [21] is attached to the flexible cable [13]. The cable [13] is moved by the shaft [23] from mechanical actuator [11] which, in turn, is moved by microprocessor [9]. As seen in FIG. 3(*a*), edge wall [22] on the disc prevents extended tube [12] from slipping, kinking etc. This edge wall [22] ensures extension of the tube along the circumference of the rotating disc [21]. Disc [21] can move in both clockwise and counter-clockwise directions to extend or contract tube [12].

It is preferred to keep the extendable hose as close to the UBA housing as possible, primarily for ease in length adjustment, but the extendable hose in FIG. 1 can be extended around the lower back, for example, if necessary. Design modifications in the linkage will have to be made in that event, but these and others will be modifications within the scope of the art and the present invention.

Figure 2:
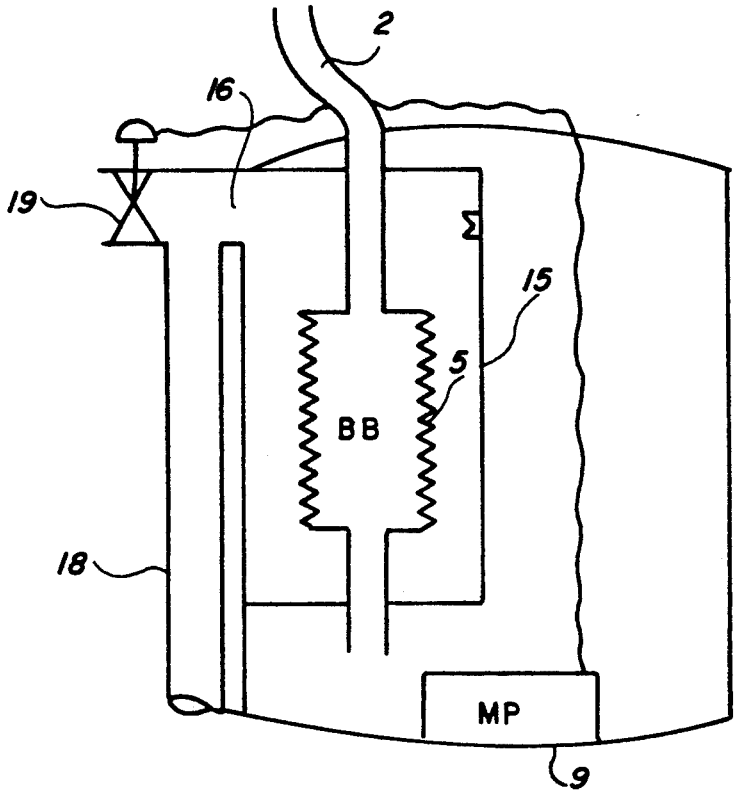
FIG. 2 is a schematic view of another preferred embodiment of the present invention with a fixed-length hose with parallel path, adjustable valve.
Figure 2A:
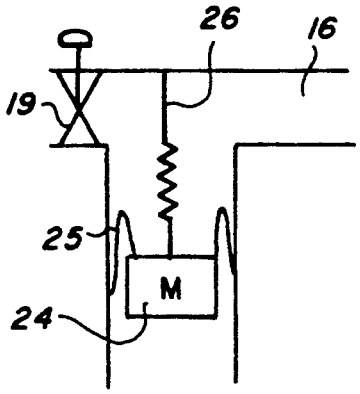

Another particularly preferred embodiment is shown in FIG. 2. Exit hose [18] is a rigid, non-extendable tube of fixed length, and adjustable bleed valve [19] acts to change the mass of water moving through the tube by creating a parallel path through which water can also flow. As the valve is operated, it can have equal, greater or less resistance than the tube. The valve is placed at one end of a tee and the fixed-length tube is attached to another end of the tee. Valve opening is controlled by microprocessor [9], or alternatively or additionally, by hand. As the valve is opened, a greater mass of water is diverted from moving through the tube and inertance is reduced. As the valve is closed the opposite occurs.

Should the electronics fail, the diver is not endangered in either preferred embodiment. The valve can be made to fail open or fail closed, and in either event water from the volume change of the breathing bag will have an opening through which to escape. Another important constraint on the ability of the UBA to oscillate is to have minimal flow resistance in the path between breathing bag housing and tube exit. A high resistance here will tend to damp out the oscillatory character of the water motion in this apparatus and negate the effect of inertance.

A further alternative in the method of adjusting inertance described above is to substitute a solid, moveable mass, denser than water, for the water in the fixed-length tube. Water displaced by the breathing bag moves this mass, and the valve bleeds off the displaced water as above. The solid mass is attached to the housing or tube by a weak spring, and a rolling seal or other means can be used to prevent leakage of displaced water past the solid, moveable mass. This embodiment is illustrated in FIG. 2(*a*) which shows that low inertance can be generated by a moving mass [24] instead of the mass of water in the fixed tube [18]. The moving mass [24] can be solid, (e.g. lead, depleted uranium etc.) or liquid, (e.g. mercury in a suitable container). Sealing means [25] prevents water from moving past the moving mass [24]. Spring [26] anchors the mass in an equilibrium position and returns it to same after mass [24] moves. Using a different mass changes the inertance in the tube. We prefer a weak spring here so as not to add additional force required to move the mass [24] which would increase the work of breathing for the diver. A rolling seal is shown in FIG. 2(*a*), but other sealing means with low friction can also be used. The advantage of this method is that smaller, or more convenient geometries for equivalent inertance can be used.

Obviously, many modifications and variations of the present invention are possible in light of the above teachings. It is therefore to be understood that, within the scope of the appended claims, the invention may be practiced otherwise than as specifically described.

What is claimed is:

1. A reactive underwater breathing apparatus (UBA) adapted to recirculate breathing gas from a diver, absorb $CO_2$, add make-up oxygen, and provide capacitance through a breathing bag, comprising:
   (a) a means for sensing the diver's breathing frequency,
   (b) a means for determining elastance of said UBA,
   (c) a means for computing resonant frequency of said UBA, and
   (d) a means for changing inertance of said UBA,
   such that UBA resonant frequency is set to equal the diver's breathing frequency.

2. The reactive UBA of claim 1, wherein said sensing means comprises a pressure transducer and a microprocessor such that said diver's breathing frequency can be determined from a measured pressure waveform of the diver's breathing characteristics.

3. The reactive UBA of claim 1, wherein said means for changing inertance of said UBA comprises an adjustable valve connected to a fixed-length tube to provide a parallel path for water to exit from an inlet connection upstream from both valve and fixed-length tube, said inlet being connected to chamber having no other openings in which said breathing bag undergoes changes in volume during a diver's breathing, such that the mass of water displaced by motion of said breathing bag and moving through said fixed-length tube is altered by said valve, thereby changing UBA inertance.

4. The reactive UBA of claim 1, wherein said means for changing inertance is to place said breathing bag in a compartment, a first opening in said compartment controlled by a valve, said valve being adjustable and adapted to bleed off selected amounts of water displaced by motion of said breathing bag, and a second opening in the compartment containing a solid, moveable mass, said mass having a sealing means to prevent leakage of water displaced by said breathing bag around said mass, said moveable mass being also attached to said compartment by a weak spring, such that mass can be moved to its original position when volume of said breathing bag decreases, and said spring is arranged so it does not substantially interfere with motion of said moveable mass.

5. The reactive UBA of claim 1, wherein said means of determining elastance of said UBA comprises an information storage means containing elastance look-up tables, a 3-axis position orientation sensor and a microprocessor capable of computing the UBA elastance by interpolation from the look-up tables upon the receipt by the information storage means of a signal from the sensor specifying spatial orientation.

6. The reactive UBA of claim 5, wherein said means for changing inertance of said UBA comprises an electro-mechanical actuating device adapted to receive a signal from the microprocessor and adjust the length of an extendable hose connected to a chamber having no other opening except the connection, said chamber containing a breathing bag which changes in volume during the diver's breathing, the mass of water displaced by motion of said breathing bag causes changes in UBA inertance.

7. The electro-mechanical actuating device of claim 6, wherein changing hose length is accomplished by said hose being fixedly attached at a moveable end to a rotating, circular disc with means to keep said hose at its periphery, and by disc rotation said hose is extended.

8. The electro-mechanical actuating device of claim 6, wherein said extendable hose is a telescoping tube.

9. The reactive UBA of claim 6, wherein said flexible, extendable hose is contained in a rigid, porous housing, so that water can move easily therethrough, and protection is afforded to said flexible hose.

10. The electro-mechanical actuating device of claim 6, wherein changing hose length is accomplished by an endless cable fixedly attached to a moveable end of said hose.

11. A method of making an underwater breathing apparatus (UBA) of the type adapted to recirculate breathing gas to a diver, absorb $CO_2$, add make-up oxygen and provide capacitance through a breathing bag, reactive to said diver's breathing by continually adjusting inertance of said UBA such that resonant frequency of said UBA matches said diver's breathing frequency, thereby minimizing impedance to breathing.

12. The method of claim 11, wherein method of continually adjusting inertance of said UBA comprises (a) sensing diver's breathing frequency, (b) computing elastance of said UBA using a microprocessor, (c) calculating resonant frequency of UBA using inertance of said UBA and microprocessor, (d) comparing frequencies from (a) and (c) and taking action on the difference through a means to adjust inertance of said UBA.

13. The method of claim 11, of adjusting inertance of said UBA to eliminate the difference between (a) and (c) by placing said breathing bag in an otherwise sealed compartment, except for an opening to which a flexible, adjustable-length hose is attached, allowing water to escape through said hose when volume of said breathing bag changes with said diver's breathing, and thereby changing the mass of water moved by the motion of said breathing bag.

14. The method of claim 11 of adjusting inertance by placing said breathing bag in an otherwise sealed compartment, except for an opening to which a tee pathway is provided, an adjustable valve being attached to one end of said tee, and a fixed-length tube being attached at the other, allowing water to escape through a path determined by the valve opening when volume of said breathing bag changes with said diver's breathing, thereby changing the mass of water moved through said fixed-length tube, thus changing inertance of said UBA.

* * * * *